US012295405B2

(12) United States Patent
Batista et al.

(10) Patent No.: US 12,295,405 B2
(45) Date of Patent: May 13, 2025

(54) INDUCTIVELY HEATABLE AEROSOL-GENERATING ARTICLE, METHOD FOR MANUFACTURING SUCH AN ARTICLE AND AN APPARATUS FOR MANUFACTURING A SUSCEPTOR OF SUCH AN ARTICLE

(71) Applicant: Philip Morris Products S.A., Neuchatel (CH)

(72) Inventors: Rui Nuno Batista, Neuchatel (CH); Yves Jordil, Neuchatel (CH); Ivan Prestia, Zola Predosa Bologna (IT)

(73) Assignee: Philip Morris Products S.A., Neuchatel (CH)

( * ) Notice: Subject to any disclaimer, the term of this patent is extended or adjusted under 35 U.S.C. 154(b) by 705 days.

(21) Appl. No.: 17/434,212

(22) PCT Filed: Feb. 27, 2020

(86) PCT No.: PCT/EP2020/055091
§ 371 (c)(1),
(2) Date: Aug. 26, 2021

(87) PCT Pub. No.: WO2020/174029
PCT Pub. Date: Sep. 3, 2020

(65) Prior Publication Data

US 2022/0132908 A1 May 5, 2022

(30) Foreign Application Priority Data

Feb. 28, 2019 (EP) ..... 19159891

(51) Int. Cl.
*A24C 5/01* (2020.01)
*A24D 1/20* (2020.01)
(Continued)

(52) U.S. Cl.
CPC ..... *A24C 5/01* (2020.01); *A24D 1/20* (2020.01); *B21D 31/04* (2013.01); *A24F 40/20* (2020.01); *A24F 40/465* (2020.01)

(58) Field of Classification Search
None
See application file for complete search history.

(56) References Cited

U.S. PATENT DOCUMENTS 741,016 A * 10/1903 Craven ..... B21D 31/046 29/6.1
3,840,405 A * 10/1974 Poirier D'Ange d'Orsay ..... H01M 12/04 429/479

(Continued)

FOREIGN PATENT DOCUMENTS

CA 2 477 431 C 4/2010
CN 102355932 A 2/2012

(Continued)

OTHER PUBLICATIONS

Metalsdepot (https://www.metalsdepot.com/aluminum-products/aluminum-expanded-metal), retrieved Apr. 12, 2024.*

(Continued)

*Primary Examiner* — Michael H. Wilson
*Assistant Examiner* — Michael T Fulton
(74) *Attorney, Agent, or Firm* — Oblon, McClelland, Maier & Neustadt, L.L.P.

(57) ABSTRACT

An inductively heatable aerosol-generating article for an inductively heating aerosol-generating device is provided, including at least one aerosol-forming substrate and at least one susceptor in thermal proximity to the aerosol-forming substrate or thermal contact with the aerosol-forming substrate, the susceptor including an expanded metal sheet including a plurality of openings through the sheet. A method for manufacturing an inductively heatable aerosol- (Continued)

generating article is also provided. An apparatus for manufacturing a susceptor of an inductively heatable aerosol-generating article is also provided.

9 Claims, 2 Drawing Sheets

(51) Int. Cl.

| | |
|---|---|
| ***B21D 31/04*** | (2006.01) |
| *A24F 40/20* | (2020.01) |
| *A24F 40/465* | (2020.01) |

(56) References Cited

U.S. PATENT DOCUMENTS

| | | | |
|---|---|---|---|
| 4,068,366 | A | 1/1978 | Hillesheim |
| 4,253,476 | A | 3/1981 | Sato |
| 9,445,629 | B2 | 9/2016 | Steinberg |
| 2008/0263841 | A1 | 10/2008 | Stelzl |
| 2009/0184504 | A1 | 7/2009 | Greenwood et al. |
| 2011/0061436 | A1 | 3/2011 | Greenwood |
| 2019/0239555 | A1 | 8/2019 | Nicholson |

FOREIGN PATENT DOCUMENTS

| | | | | |
|---|---|---|---|---|
| DE | 10 2006 048 125 | B4 | 5/2010 | |
| EA | 013849 | B1 | 8/2010 | |
| JP | 6-210368 | A | 8/1994 | |
| JP | 2018-530318 | A | 10/2018 | |
| KR | 10-2009-0120489 | A | 11/2009 | |
| WO | WO 2015/176898 | A1 | 11/2015 | |
| WO | WO 2015/177256 | A1 | 11/2015 | |
| WO | WO 2016/184928 | A1 | 11/2016 | |
| WO | WO 2016/184929 | A1 | 11/2016 | |
| WO | WO 2017/178394 | A1 | 10/2017 | |
| WO | WO-2018002084 | A1 * | 1/2018 | ..... A24B 15/167 |
| WO | WO-2018122356 | A1 * | 7/2018 | |
| WO | WO 2018/229087 | A1 | 12/2018 | |

OTHER PUBLICATIONS

Russian Search Report issued Jun. 8, 2023 in Russian Patent Application No. 2021128163 (with English Translation), 4 pages.
Office Action issued Mar. 4, 2024, in corresponding Japanese Patent Application No. 2021-549831, 5 pages.
Office Action issued Nov. 14, 2023, in corresponding Brazilian Patent Application No. BR112021016899-0 (with English Translation), 5 pages.
International Search Report and Written Opinion issued on Jun. 8, 2020 in PCT/EP2020/055091 filed on Feb. 27, 2020.

* cited by examiner

INDUCTIVELY HEATABLE AEROSOL-GENERATING ARTICLE, METHOD FOR MANUFACTURING SUCH AN ARTICLE AND AN APPARATUS FOR MANUFACTURING A SUSCEPTOR OF SUCH AN ARTICLE

The present invention relates to an inductively heatable aerosol-generating article for use with an inductively heating aerosol-generating device. The invention also relates to a method for manufacturing such an inductively heatable aerosol-generating article. The invention further relates to an apparatus for manufacturing a susceptor of such an article.

Aerosol-generating articles including at least one aerosol-forming substrate that is capable to form an inhalable aerosol when heated are generally known. For heating the substrate, the article may be received within an aerosol-generating device which comprises an electrical heater. The heater may be an inductive heater comprising an induction source. The induction source is configured for generating an alternating electromagnetic field to inductively heat a susceptor by at least one of eddy currents and hysteresis losses, depending on the electrical and magnetic properties of the susceptor. The susceptor may be integral part of the article and arranged such as to be in thermal proximity or direct physical contact with the substrate to be heated. In operation of the device, volatile compounds are released from the heated aerosol-forming substrate in the article and entrained in an airflow that is drawn through the article during a user's puff. As the released compounds cool, they condense to form an aerosol.

The susceptor may comprise or may consist of a metal sheet. Although such sheet-like susceptors can be easily manufactured and provide extensive heat emission due to their two-dimensional nature, the total mass of such susceptors may be often still disproportional to the heat emission surface. Thus, resources are not efficiently used.

Therefore, it would be desirable to have an inductively heatable aerosol-generating article and a method for manufacturing such an article with the advantages of prior art solutions but without their limitations. In particular, it would be desirable to have an inductively heatable aerosol-generating article and a method for manufacturing such an article involving an improved use of resources.

According to the invention there is provided an inductively heatable aerosol-generating article for use with an inductively heating aerosol-generating device. The article comprises at least one aerosol-forming substrate and at least one susceptor in thermal proximity with the aerosol-forming substrate or thermal contact to the aerosol-forming substrate. The susceptor comprises an expanded metal sheet comprising a plurality of openings through the sheet.

As used herein, the term "expanded metal sheet" refers to a type of metal sheet in which a plurality of weakened areas, in particular a plurality of perforations have been created and which subsequently has been stretched to form a regular pattern of openings originating from stretching the plurality of weakened areas, in particular from the plurality of perforations.

Using a susceptor comprising an expanded metal sheet provides a plurality of advantages as compared to other types of sheet-like susceptors.

First, due to the specific manufacturing process the mass per unit area of the expanded metal sheet is decreased as compared to a metal sheet without such openings. At the same time, the surface of the expanded metal sheet is still sufficiently large to provide extensive heat emission. As a result, the proportional rate between the total mass and the heat emission surface of a susceptor comprising an expanded metal sheet is improved as compared to a susceptor comprising a metal sheet without any openings. Advantageously, this helps to conserve resources for the manufacturing of the article. In addition, the reduced mass per unit area may also be beneficial with regard to a reduced total mass of the article.

Second, in comparison to a metal sheet comprising openings which have been created by material removal, for example by punching, the manufacturing of an expanded metal sheet comprising openings which have been created as described above, that is, by weakening, in particular perforating and stretching a metal sheet, advantageously does not involve a waste of material. Also for this reason, the susceptor of the article according to the present invention advantageously allows to save materials and production costs, and thus to conserve resources.

Third, due to the openings, the susceptor of the article according to the present invention is permeable causing the airflow drawn through the article to be enhanced as compared to an article comprising a non-permeable susceptor. In addition, the openings of the susceptor facilitate the release and entrainment of the material that is volatilized from the heated aerosol-forming substrate into the airflow. Advantageously, both aspects facilitate aerosol formation.

Fourth, a susceptor comprising an expanded metal sheet is more robust as compared to an equivalent weight of a welded or woven susceptor mesh, because the sheet material—though being weakened, in particular perforated, and stretched—stays in one piece and thus retains its strength. At the same time, an expanded metal sheet is more flexible and less stiff than a metal sheet without any openings. Advantageously, this facilities the material supply during the manufacturing of the aerosol-generating article.

Fifth, the openings of the expanded metal sheet may get filled with aerosol-forming substrate during the manufacturing of the article. Advantageously, this may support fixation of the susceptor within the aerosol-forming substrate. As a consequence, the positional accuracy and stability of the susceptor within the aerosol-forming substrate is significantly improved.

As used herein, the term "sheet" refers to a flat object which has an extension in a first direction, in particular a thickness extension, which is smaller, in particular at least 5 times smaller, preferably at least 20 times smaller, more preferably at least 50 times smaller, even more preferably at least 100 times smaller, most preferably at least 150 times smaller than an extension in a second and a third direction, in particular than a width extension and a length extension. Furthermore, the extension of the sheet in the second direction preferably is smaller than the extension of the sheet in the third direction. In particular, a width extension of the sheet may be smaller than a length extension of the sheet. With regard to dimensions of the susceptor, the expanded metal sheet may have a thickness extension in a range of 0.05 millimeter to 0.4 millimeter, in particular in a range of 0.15 millimeter to 0.35 millimeter. Likewise, the expanded metal sheet may have a width extension in a range of 2 millimeter to 8 millimeter, in particular in a range of 3 millimeter to 6 millimeter, preferably in a range of 4 millimeter to 5 millimeter.

As used herein, the terms "metal sheet" and "expanded metal sheet" refer to a sheet which comprises at least one metal or metallic material. Due to this, the susceptors is electrically conductive and, thus, inductively heatable at least due to eddy currents.

As used herein, the term "openings" is to be understood as an opening which extends through the entire expanded sheet material along its thickness extension, from one plane side to the opposite plane side of the expanded sheet material. Likewise, the term "perforation" is to be understood as a perforation that extends through the entire sheet material along its thickness extension, from one plane side to the opposite plane side of the sheet material. The term "weakened area" refers to an area of the metal sheet which has a reduced material thickness in a direction perpendicular to the main surface of the metal sheet, that is, along a thickness extension of the metal. The reduction of the material thickness is such that upon stretching the weakened metal sheet the weakened area is transformed into an opening through the entire expanded sheet material along its thickness extension.

Furthermore, the term "openings" may cover two types of openings, namely, openings having a closed boundary as well as openings having a partially open boundary. An opening having a closed boundary is completely bounded by the material of the expanded metal sheet along the perimeter of the opening. In contrast, an opening having a partially open boundary is only partially bounded by the material of the expanded metal sheet along the perimeter of the opening. If present, the one or more openings having a partially open boundary are located at a side edge of the expanded metal sheet. That is, such openings are laterally opened up towards a side edge of the expanded metal sheet. If present, the one or more openings having a partially open boundary may result from weakened areas, in particular perforations created in a metal sheet that extend beyond the side edge of the metal sheet and which are subsequently stretched.

Accordingly, the expanded metal sheet may comprise one of: a plurality of openings having a closed boundary; a plurality of openings having a partially open boundary; or one or more openings having a closed boundary as well as one or more openings having a partially open boundary.

The plurality of openings may be arranged in a periodic pattern. A periodic pattern may be advantageous with regard to its manufacturing. In particular, the periodic pattern of openings may be achieved by creating a periodic pattern of weakened areas, in particular perforations in a sheet material and by subsequently stretching the weakened, in particular perforated metal sheet at least in one direction such that the periodic pattern of weakened areas, in particular perforations transforms into in the periodic pattern of openings.

The periodic pattern of openings may be a one-dimensional periodic pattern. That is, the periodic pattern may have a periodicity along a first (along one) direction only. Preferably, the periodic pattern is a two-dimensional periodic pattern. That is, the periodic pattern may have a periodicity along a first direction and a second direction, wherein the second direction is transverse, in particular perpendicular to the first direction. In both configurations, the first direction may correspond to a direction of expansion of the expanded sheet material.

The periodic pattern of the plurality of openings may have a length of periodicity along the first direction in a range of 0.9 millimeter to 7.8 millimeter, preferably in a range of 1.4 millimeter to 4.8 millimeter. Likewise, the periodic pattern of the plurality of openings may have a length of periodicity along the second direction in a range of 3.4 millimeter to 9 millimeter, preferably in a range of 2.6 millimeter to 5.1 millimeter. Periodicities along the first and second direction within these ranges may provide a reasonable ratio between the total mass and the heat emission surface of the susceptor.

The plurality of openings may be arranged in an offset arrangement, in particular a periodic offset arrangement. Advantageously, an offset arrangement allows for a very compact arrangement of the openings resulting in an increased density of openings per unit area which in turn enables to increase the permeability of the susceptor and at the same time to reduce the total mass per unit area of the susceptor material. As mentioned above, the latter allows for a more efficient use of resources. In particular, in the offset arrangement, the plurality of openings may be arranged in a plurality of rows along a first direction, wherein each row extends in a second direction perpendicular to the first direction and comprises one or more openings, and wherein the one or more openings in one row are offset to the one or more openings in each neighboring row. The offset arrangement of openings may be achieved by creating a corresponding offset arrangement of weakened areas, in particular perforations, where the plurality of weakened areas, in particular perforations may be arranged in a plurality of rows along a first direction, wherein each row extends in a second direction perpendicular to the first direction and comprises one or more weakened areas, in particular perforations, and wherein the one or more weakened areas, in particular perforations in one row are offset to the one or more weakened areas, in particular perforations in each neighboring row.

In general, the shape of the openings may depend on the manufacturing of the expanded metal sheet, in particular on the shape of the weakened areas in the metal sheet, such as for example on the shape of perforations, and on the direction of expansion in which the weakened, for example perforated metal sheet is stretched such as to generate the openings. As used herein, the term "shape of the opening" refers to the (cross-sectional) shape of the opening as seen in a direction perpendicular to the main (plane) surface of the expanded metal sheet, that is, along the direction of the smallest extension of the expanded metal sheet which is the thickness extension of the expanded metal sheet.

Preferably, one or more of the plurality of openings may have a rhombus shape. Rhombus-shaped openings may be advantageous as they are easy to manufacture, in particular by creating straight slits of finite length in a metal sheet and subsequently by stretching the slit metal sheet in a direction transverse, in particular perpendicular to the length extension of the straight slits which causes each of the slits to turn into a rhombus-shaped openings.

A rhombus shape has a first diagonal connecting a first pair of opposite vertices of the rhombus shape and a second diagonal connecting a second pair of opposite vertices of the rhombus shape. Preferably, the first diagonal extends in a first direction which corresponds to a direction of expansion of the expanded metal sheet. The situation may be easily achieved by stretching the metal sheet in a direction perpendicular to the length extension of the above-mentioned straight slits.

Preferably, the length of the second diagonal is larger than the length of the first diagonal, in particular in case the first diagonal corresponds to a direction of expansion of the expanded metal sheet. As compared to a rhombus-shaped opening having the same opening area but even diagonals, the above configuration advantageously allows for reducing the degree of expansion which makes the manufacturing of the expanded metal sheet easier.

The length of the first diagonal may be in a range of 0.3 millimeter to 3.1 millimeter, preferably in a range of 0.5 millimeter 2.5 millimeter. Likewise, the length of the second diagonal is in a range of 1.1 millimeter to 4.7 millimeter, preferably in a range of 1.7 millimeter to 3.1 millimeter.

Likewise, the length of the second diagonal may be in a range of 10 percent to 60 percent, in particular 20 percent to 50 percent, preferably 30 percent to 45 percent of a width extension of the expanded metal sheet.

If one or more the aforementioned straight slits extends beyond the edge of the metal sheet, stretching of such slits results in openings which have a partially open boundary, as mentioned above, and in particular a triangular shape. As to this, it is to be noted that the partially open part of the boundary of the opening corresponds to one of the edges of the triangle or the triangular shape, respectively. Accordingly, one or more of the plurality of openings may be laterally opened up towards a side edge of the expanded metal sheet and may have a triangular shape.

Preferably, the aforementioned straight slits extend in a direction perpendicular to a side edge of the metal sheet the expanded metal sheet of made of as described below in more detail. In particular, the slits may extend in a direction perpendicular to a length extension of the metal sheet the expanded metal sheet of made. The length extension of the metal sheet preferably corresponds to the direction of expansion of the expanded metal sheet.

Alternatively, the slits may be angled by an angle in a range of 5 degree to 85 degree, in particular 20 degree to 70 degree, preferably 30 degree to 60 degree, for example 45 degree with regard to a side edge or a length extension of the metal sheet. Stretching these slits in a direction parallel to the side edge or length extension of the metal sheet may result in a three-dimensional configuration of the expanded metal sheet having raised portions which protrude in a direction perpendicular to the main (plane) surface of the expanded metal sheet. Advantageously, such raised portions may support fixation of the susceptor within the aerosol-forming substrate. If desired, the raised portions may be flattened. That is, the susceptor may comprise a flattened expanded metal sheet comprising a plurality of openings through the sheet. In particular, the susceptor may comprise a flattened expanded metal sheet comprising a plurality of openings through the sheet and having no raised portions which protrude in a direction perpendicular to the main plane surface of the expanded metal sheet.

The expanded metal sheet of the susceptor may be strip-shaped. As used in term "strip-shaped" refers to the shape of an element having a length extension and a width extension which are both larger than a thickness extension. In addition, the length extension preferably is larger than the width dimension. The thickness extension may the in a range of 0.05 millimeter to 0.4 millimeter, in particular in a range of 0.15 millimeter to 0.35 millimeter. Likewise, the width extension may be in a range of 2 millimeter to 8 millimeter, in particular in a range of 3 millimeter to 6 millimeter, preferably in a range of 4 millimeter to 5 millimeter. Preferably, the strip-shaped expanded metal sheet has a rectangular cross-section as seen in a plane perpendicular to its length extension. The length extension preferably corresponds to the direction of expansion of the expanded metal sheet. A susceptor or an expanded metal sheet in the form of a strip is advantageous as it can be easily manufactured at low costs.

Preferably, the susceptor solely consists of an expanded metal sheet, in particular a strip-shaped expanded metal sheet. That is, the susceptor preferably is an expanded metal sheet, in particular a strip-shaped expanded metal sheet.

In general, the term "susceptor" refers to an element comprising a material that is capable of being inductively heated within an alternating electromagnetic field. This may be the result of at least one of hysteresis losses and eddy currents induced in the susceptor, depending on the electrical and magnetic properties of the susceptor material. Hysteresis losses occur in ferromagnetic or ferrimagnetic susceptors due to magnetic domains within the material being switched under the influence of an alternating electromagnetic field. Eddy currents may be induced if the susceptor is electrically conductive. In case of an electrically conductive ferromagnetic susceptor or an electrically conductive ferrimagnetic susceptor, heat can be generated due to both, eddy currents and hysteresis losses.

In the present invention, the susceptor is inductively heatable at least due to eddy currents because of the expanded metal sheet which is electrically conductive due to its metallic nature. Therefore, the susceptor according to the present invention, in particular the expanded metal sheet, comprises at least one material which is electrically conductive. The electrically conductive material may be paramagnetic. For example, the electrically conductive material may be or may comprise aluminum. Alternatively, the electrically conductive material may be ferromagnetic. In this case, the susceptor according to the present invention is heatable due to both, eddy currents and hysteresis losses. For example, the electrically conductive material may be or may comprise ferritic iron, a ferromagnetic alloy, in particular ferromagnetic steel, preferably a ferromagnetic stainless steel.

A preferred susceptor may be heatable to a temperature between about 40 degree Celsius and about 500 degree Celsius, in particular between about 50 degree Celsius and about 450 degree Celsius, preferably between about 100 degree Celsius and about 400 degree Celsius.

The susceptor may be a multi-material susceptor. In particular, the expanded metal sheet may be a multi-material expanded metal sheet. Accordingly, the susceptor or the expanded metal sheet, respectively, may comprise at least a first metallic material and a second metallic material. The first material preferably is optimized with regard to heat loss and thus heating efficiency. For example, the first material may be aluminum, or a ferrous material such as a stainless steel. In contrast, the second material preferably is used as temperature marker. For this, the second material preferably is ferromagnetic and chosen such as to have a Curie temperature corresponding to a predefined heating temperature of the susceptor. At its Curie temperature, the magnetic properties of the second material change from ferromagnetic to paramagnetic, accompanied by a temporary change of its electrical resistance. Thus, by monitoring a corresponding change of the electrical current absorbed by the induction source it can be detected when the second material has reached its Curie temperature and, thus, when the predefined heating temperature has been reached. The second material preferably has a Curie temperature that is below the ignition point of the aerosol-forming substrate of the aerosol-generating article, that is, preferably lower than 500 degree Celsius. Suitable materials for the second material may include nickel and certain nickel alloys. Nickel has a Curie temperature in the range of about 354 degree Celsius to 360 degree Celsius depending on the nature of impurities. A Curie temperature in this range is ideal because it is approximately the same as the temperature that the susceptor should be heated to in order to generate an aerosol from the aerosol-forming substrate, but still low enough to avoid local overheating or burning of the substrate.

The susceptor may be a multi-layer susceptor. Likewise, the expanded metal sheet may be a multi-layer expanded metal sheet. In particular, the multi-layer susceptor comprises a multi-layer expanded metal sheet. The multi-layer susceptor or the multi-layer expanded metal sheet, respectively, may comprise a first layer and a second layer, wherein the first layer comprises a first metallic material and the second layer comprises a second metallic material as described before. For example, the first layer may comprise or may be made of a ferromagnetic stainless steel, wherein at least one side of the first layer comprises a coating as second layer which may comprise or may be made of nickel or a nickel alloy.

Preferably, the susceptor is dimensionally stable. That means that the susceptor substantially remains undeformed during manufacturing of the aerosol-forming rod or that any deformation of the susceptor required to form the aerosol-forming rod remains elastic such that the susceptor returns to its intended shape when the deforming force is removed. For this, the shape and material of the susceptor may be chosen such as to ensure sufficient dimensional stability. Advantageously, this assures that the originally desired cross-sectional profile is preserved throughout the manufacturing of the aerosol-forming rod. A high dimensional stability reduces the variability of the product performance. With regard to the shaping device according to the present invention and as described in detail further below this means, that the shaping device is configured such that the susceptor substantially remains undeformed after passing through the shaping device. This means that preferably any deformation of the susceptor required to form a continuous rod remains elastic such that the susceptor returns to its intended shape when the deforming force is removed.

As used herein, the term "aerosol-forming substrate" denotes a substrate formed from or comprising an aerosol-forming material that is capable of releasing volatile compounds upon heating for generating an aerosol. The aerosol-forming substrate is intended to be heated rather than combusted in order to release the aerosol-forming volatile compounds.

The aerosol-forming substrate may be a solid, a paste-like or a liquid aerosol-forming substrate. In any of these states, the aerosol-forming substrate may comprise both, solid and liquid components.

The aerosol-forming substrate may comprise a tobacco-containing material containing volatile tobacco flavor compounds, which are released from the substrate upon heating.

Alternatively or additionally, the aerosol-forming substrate may comprise a non-tobacco material, in particular a non-tobacco plant material, such as a cut botanical material or botanical expanded fibers or a porous substrate or foam based on botanical fibers or combinations thereof.

The aerosol-forming substrate may comprise, for example, one or more of: powder, granules, pellets, shreds, spaghetti strands, strips or sheets containing one or more of: herb leaf, tobacco leaf, fragments of tobacco ribs, reconstituted tobacco, homogenized tobacco, extruded tobacco and expanded tobacco and combinations thereof.

The aerosol-forming substrate may further comprise at least one aerosol former. The at least one aerosol former may be selected from the polyols, glycol ethers, polyol ester, esters, and fatty acids and may comprise one or more of the following compounds: glycerin, erythritol, 1,3-butylene glycol, tetraethylene glycol, triethylene glycol, triethyl citrate, propylene carbonate, ethyl laurate, triacetin, meso-Erythritol, a diacetin mixture, a diethyl suberate, triethyl citrate, benzyl benzoate, benzyl phenyl acetate, ethyl vanillate, tributyrin, lauryl acetate, lauric acid, myristic acid, and propylene glycol.

One or more aerosol formers may be combined to take advantage of one or more properties of the combined aerosol formers. For example, triacetin may be combined with glycerin and water to take advantage of the triacetin's ability to convey active components and the humectant properties of the glycerin.

The aerosol former may also have humectant type properties that help maintain a desirable level of moisture in an aerosol-forming substrate when the substrate is composed of a tobacco-based product, particularly including tobacco particles. In particular, some aerosol formers are hygroscopic material that functions as a humectant, that is, a material that helps keep a tobacco substrate containing the humectant moist.

In particular the aerosol-forming substrate may comprise one or more aerosol-formers with a weight proportion in a range of 12 percent to 20 percent, preferably 16 percent to 20 percent, most preferably 17 percent to 18 percent by weight of the aerosol-forming substrate.

The aerosol-forming substrate may comprise other additives and ingredients. The aerosol-forming substrate preferably comprises nicotine. The aerosol-forming substrate may comprise flavourants, in particular additional tobacco or non-tobacco volatile flavor compounds, to be released upon heating of the aerosol-forming substrate. The aerosol-forming substrate also may contain capsules that, for example, include the additional tobacco or non-tobacco volatile flavor compounds and such capsules may melt during heating of the solid aerosol-forming substrate. The aerosol-forming substrate also may comprise a binder material.

Preferably, the aerosol-forming substrate is an aerosol-forming tobacco substrate, that is, a tobacco containing substrate. The aerosol-forming substrate may contain volatile tobacco flavor compounds, which are released from the substrate upon heating. The aerosol-forming substrate may comprise or consist of reconstituted tobacco, such as homogenized tobacco material. Homogenized tobacco material may be formed by agglomerating particulate tobacco. In particular, the aerosol-forming substrate may comprise or consist of cut and blended tobacco lamina. The aerosol-forming substrate may additionally comprise a non-tobacco material, for example homogenized plant-based material other than tobacco. Preferably, the reconstituted tobacco is made to a large extend from blended tobacco material, in particular leaf lamina, processed stems and ribs, homogenized plant material, like for example made into sheet form using casting or papermaking processes. The reconstituted tobacco may also comprise other after-cut, filler tobacco, binder, fibers or casing. The reconstituted tobacco may comprise at least 25 percent of plant leaf lamina, more preferably, at least 50 percent of plant leaf lamina, still more preferably at least 75 percent of plant leaf lamina and most preferably at least 90 percent of plant leaf lamina. Preferably, the plant material is one of tobacco, mint, tea and cloves. However, the plant material may also be another plant material that has the ability to release substances upon the application of heat that can subsequently form an aerosol.

Preferably, the tobacco plant material comprises lamina of one or more of bright tobacco lamina, dark tobacco, aromatic tobacco and filler tobacco. Bright tobaccos are tobaccos with a generally large, light colored leaves. Throughout the specification, the term "bright tobacco" is used for tobaccos that have been flue cured. Examples for bright tobaccos are Chinese Flue-Cured, Flue-Cured Brazil, US Flue-Cured such as Virginia tobacco, Indian Flue-Cured, Flue-Cured from Tanzania or other African Flue Cured.

Bright tobacco is characterized by a high sugar to nitrogen ratio. From a sensorial perspective, bright tobacco is a tobacco type which, after curing, is associated with a spicy and lively sensation. As used herein, bright tobaccos are tobaccos with a content of reducing sugars of between about 2.5 percent and about 20 percent of dry weight base of the leaf and a total ammonia content of less than about 0.12 percent of dry weight base of the leaf. Reducing sugars comprise for example glucose or fructose. Total ammonia comprises for example ammonia and ammonia salts. Dark tobaccos are tobaccos with a generally large, dark colored leaves. Throughout the specification, the term "dark tobacco" is used for tobaccos that have been air cured. Additionally, dark tobaccos may be fermented. Tobaccos that are used mainly for chewing, snuff, cigar, and pipe blends are also included in this category. Typically, these dark tobaccos are air cured and possibly fermented. From a sensorial perspective, dark tobacco is a tobacco type which, after curing, is associated with a smoky, dark cigar type sensation. Dark tobacco is characterized by a low sugar to nitrogen ratio. Examples for dark tobacco are Burley Malawi or other African Burley, Dark Cured Brazil Galpao, Sun Cured or Air Cured Indonesian Kasturi. As used herein, dark tobaccos are tobaccos with a content of reducing sugars of less than about 5 percent of dry weight base of the leaf and a total ammonia content of up to about 0.5 percent of dry weight base of the leaf. Aromatic tobaccos are tobaccos that often have small, light colored leaves. Throughout the specification, the term "aromatic tobacco" is used for other tobaccos that have a high aromatic content, e.g. of essential oils. From a sensorial perspective, aromatic tobacco is a tobacco type which, after curing, is associated with spicy and aromatic sensation. Examples for aromatic tobaccos are Greek Oriental, Oriental Turkey, semi-oriental tobacco but also Fire Cured, US Burley, such as Perique, Rustica, US Burley or Meriland. Filler tobacco is not a specific tobacco type, but it includes tobacco types which are mostly used to complement the other tobacco types used in the blend and do not bring a specific characteristic aroma direction to the final product. Examples for filler tobaccos are stems, midrib or stalks of other tobacco types. A specific example may be flue cured stems of Flue Cure Brazil lower stalk. Preferably, the aerosol-forming substrate may comprise a tobacco web, preferably a crimped web. The tobacco web may comprise tobacco material, fiber particles, a binder material and an aerosol former. Preferably, the tobacco web is cast leaf. Cast leaf is a form of reconstituted tobacco that is formed from a slurry including tobacco particles. The cast leaf may further comprise fiber particles or aerosol former, or both of fiber particles and aerosol former, and a binder and for example also flavors. Tobacco particles may be of the form of a tobacco powder having particles in the order of 10 micrometer to 250 micrometer, preferably in the order of 20 micrometer to 80 micrometer or 50 micrometer to 150 micrometer or 100 micrometer to 250 micrometer, depending on the desired sheet thickness and casting gap of a corresponding casting box. The casting gap influences the thickness of the sheet. Fiber particles may include tobacco stem materials, stalks or other tobacco plant material, and other cellulose-based fibers such as for example plant fibers, preferably wood fibers or flax fibers or hemp fibers. Fiber particles may be selected based on the desire to produce a sufficient tensile strength for the cast leaf versus a low inclusion rate, for example, an inclusion rate between approximately 2 percent to 15 percent. Alternatively, fibers, such as vegetable fibers, may be used either with the above fiber particles or in the alternative, including hemp and bamboo or combinations of various fiber types. Aerosol formers included in the slurry forming the cast leaf or used in other aerosol-forming tobacco substrates may be chosen based on one or more characteristics. Functionally, the aerosol former provides a mechanism that allows it to be volatilized and convey nicotine or flavoring or both in an aerosol when heated above the specific volatilization temperature of the aerosol former. Different aerosol formers typically vaporize at different temperatures. The aerosol-former may be any suitable known compound or mixture of compounds that, in use, facilitates formation of a stable aerosol. A stable aerosol is substantially resistant to thermal degradation at the operating temperature for heating the aerosol-forming substrate. An aerosol former may be chosen based on its ability, for example, to remain stable at or around room temperature but able to volatize at a higher temperature, for example, between 40 degree Celsius and 450 degree Celsius, preferably between 40 degree Celsius and 250 degree Celsius.

A crimped tobacco sheet, for example cast leaf, may have a thickness in a range of between about 0.02 millimeter and about 0.5 millimeter, preferably between about 0.08 millimeter and about 0.2 millimeter.

In case of a liquid aerosol-forming substrate, the aerosol-generating article may comprise a liquid retention material including the liquid aerosol-forming substrate. As used herein, the term "liquid retention material" refers to a high retention or high release material (HRM) for storing a liquid. The liquid retention material is configured to intrinsically retain at least a portion of the liquid, which in turn is not available for aerosolization before having left the retention. Using a liquid retention material reduces the risk of spill in case of failure or cracks of the aerosol-generating article due to the liquid aerosol-forming substrate being safely held in the retention material. Advantageously, this allows the aerosol-generating article to be leak proof.

Within the aerosol-generating article, the aerosol-forming substrate may be arranged at least partially around the susceptor. In this configuration, the susceptor is at least partially surrounded by the aerosol-forming substrate such as to heat the substrate from inside. Due to this, the hottest parts of the article, which is the susceptor, is shielded from the periphery of the article by the substrate. In addition, the susceptor is securely fixed and protected by the least partially surrounding aerosol-forming substrate.

Alternatively, the susceptor may be arranged at least partially around the aerosol-forming substrate. This configuration is advantageous with regard to a homogenous heating of the surrounded aerosol-forming substrate from outside, wherein the surrounding susceptor forms a heating chamber around the substrate.

In addition to the at least one aerosol-forming substrate and the at least one susceptor, the aerosol-generating article may comprise one or more further substrates. Likewise, the aerosol-generating article may comprise one or more further susceptors.

Moreover, the aerosol-generating article may comprise different portions each of which comprises at least one of an aerosol-forming substrate, a flavoring material and a filler material.

As a first example, the aerosol-generating article may comprise:

- at least one cylindrical core portion comprising at least one of a first aerosol-forming substrate and a first flavoring material;
- at least one elongate susceptor which comprises an expanded metal sheet comprising a plurality of openings through the sheet laterally, and which laterally abuts the cylindrical core portion in a non-bonded manner along its length extension; and a sleeve portion arranged around the core portion and the susceptor, wherein the sleeve comprises at least one of a filler material, a second aerosol-forming substrate and a second flavoring material.

As a second example, the aerosol-generating article may comprise:

a first cylindrical core portion comprising a first aerosol-forming substrate and a first flavoring material;

a second cylindrical core portion separate from the first core portion comprising at least one of a second aerosol-forming substrate and a second flavoring material;

at least one elongate susceptor which comprises an expanded metal sheet comprising a plurality of openings through the sheet, and which laterally abuts the first and the second core portion in a non-bonded manner such that the susceptor is sandwiched between the first and the second core portion; and a sleeve portion arranged around the first and the second core portion and the susceptor, wherein the sleeve portion comprises at least one of a filler material, a third aerosol-forming substrate and a third flavoring material.

As a third example, the aerosol-generating article may comprise:

at least one cylindrical core portion comprising at least one of a first aerosol-forming substrate and a first flavoring material;

a first elongate susceptor which comprises an expanded metal sheet comprising a plurality of openings through the sheet, and which laterally abuts the cylindrical core portion—preferably in a non-bonded manner—at a first side along its length extension;

a second elongate susceptor which comprises an expanded metal sheet comprising a plurality of openings through the sheet, and which laterally abuts the cylindrical core portion—preferably in a non-bonded manner—at second side along its length extension opposite to the first side such that the cylindrical core portion is sandwiched between the first and the second elongate susceptor; and a sleeve portion arranged around the core portion and the first and the second susceptor, wherein the sleeve comprises at least one of a filler material, a second aerosol-forming substrate and a second flavoring material.

The aerosol-generating article, in particular at least one of the portions of the aforementioned first, second and third examples, may comprise at least one of:

a porous substrate or foam based on tobacco fibers, wherein the tobacco fibers at least partially form a respective aerosol-forming substrate;

a porous substrate or foam based on botanical fibers, wherein the botanical fibers at least partially form a respective aerosol-forming substrate;

a filler comprising a cut tobacco material, wherein the cut tobacco material at least partially forms a respective aerosol-forming substrate;

a filler comprising a cut botanical material, wherein the cut botanical material at least partially forms a respective aerosol-forming substrate;

a liquid retention material including an aerosol-forming liquid, wherein the aerosol-forming liquid at least partially forms a respective aerosol-forming substrate.

Likewise, the aerosol-generating article, in particular at least one of the portions of the aforementioned first, second and third examples, may comprise at least one of:

a liquid retention material including at least one flavoring substance, wherein the flavoring substance at least partially forms a respective flavoring material;

cellulose fibers or cellulose-based fibers (as filler material);

cellulose fibers or cellulose-based fibers, including at least one flavoring substance, wherein the flavoring substance at least partially forms a respective flavoring material;

acetate tow expanded fibers (as filler material);

botanical expanded fibers (as filler material); or paper (as filler material).

As used herein, cut tobacco material may comprise at least one shreds of tobacco lamina, reconstituted tobacco, shreds of tobacco ribs or shreds of tobacco stems. Likewise, cut botanical material may comprise at least one shreds of botanical lamina, shreds of botanical ribs or shreds of botanical stems.

In general, the aerosol-generating article may be a consumable, in particular a single-use consumable. The aerosol-generating article may be a tobacco article. In particular, the article may be a rod-shaped article resembling cigarettes.

Preferably, the inductively heatable aerosol-generating article has a circular or elliptical or oval cross-section. However, the article may also have a square or rectangular or triangular or other polygonal cross-section.

The at least one aerosol-forming substrate and the at least one susceptor may be integral part of an aerosol-forming rod. The aerosol-forming rod may be part a rod-shaped aerosol-generating article. Likewise, the different portions and susceptor according to the three examples described before may be integral part of an aerosol-forming rod which in turn may be part of a rod-shaped aerosol-generating article. Preferably, a length dimension of the susceptor substantially corresponds to the length dimension of the aerosol-forming rod as measured along the longitudinal axis of the aerosol-forming rod. However, it may be advantageous to have a susceptor where the length dimension of the susceptor is smaller than the length dimension of the aerosol-forming rod.

In addition to the aerosol-forming substrate and the susceptor, in particular in addition to the aerosol-forming rod, the article may further comprise one or more different elements, in particular one or more of: a support element having a central air passage, an aerosol-cooling element, and a filter element. Any one or any combination of these elements may preferably be arranged sequentially to the aerosol-forming rod. Preferably, the aerosol-forming rod is arranged at a distal end of the article. Likewise, the filter element preferably is arranged at a proximal end of the article. Furthermore, these elements may have the same outer cross-section as the aerosol-forming rod. Preferably, the aerosol-forming rod, the filter element, the support element and the aerosol-cooling element have an external diameter of between 5 millimeter and 10 millimeter, for example of between 6 millimeter and 8 millimeter. In a preferred embodiment, the filter element has an external diameter of 7.2 millimeter plus or minus 10 percent.

The filter element preferably serves as a mouthpiece, or as part of a mouthpiece together with the aerosol-cooling element. As used herein, the term "mouthpiece" refers to a portion of the article through which the aerosol exits the aerosol-generating article. The filter element preferably has an external diameter that is approximately equal to the external diameter of the aerosol-generating article. The filter element may have an external diameter of between 5 millimeter and 10 millimeter, for example of between 6 millimeter and 8 millimeter. In a preferred embodiment, the filter element has an external diameter of 7.2 millimeter 10 percent, preferably plus or minus 5 percent. The filter element may have a length of between 5 millimeter and 25 millimeter, preferably a length of between 10 millimeter and 17 millimeter. In a preferred embodiment, the filter element has a length of 12 millimeter or 14 millimeter. In another preferred embodiment, the filter element has a length of 7 millimeter.

The support element may be located immediately downstream of the aerosol-forming rod. The support element may abut the aerosol-forming rod. The support element may be formed from any suitable material or combination of materials. For example, the support element may be formed from one or more materials selected from the group consisting of: cellulose acetate; cardboard; crimped paper, such as crimped heat resistant paper or crimped parchment paper; and polymeric materials, such as low density polyethylene (LDPE). In a preferred embodiment, the support element is formed from cellulose acetate. The support element may comprise a hollow tubular element. In a preferred embodiment, the support element comprises a hollow cellulose acetate tube.

The support element preferably has an external diameter that is approximately equal to the external diameter of the aerosol-generating article. The support element may have an external diameter of between 5 millimeter and 12 millimeter, for example of between 5 millimeter and 10 millimeter or of between 6 millimeter and 8 millimeter. In a preferred embodiment, the support element has an external diameter of 7.2 millimeter plus or minus 10 percent, preferably plus or minus 5 percent. The support element may have a length of between 5 millimeter and 15 millimeter, in particular between 6 millimeter and 12 millimeter. In a preferred embodiment, the support element has a length of 8 millimeter.

As used herein, the term "'aerosol-cooling element" is used to describe an element having a large surface area and a low resistance to draw, for example 15 mmWG to 20 mmWG. In use, an aerosol formed by volatile compounds released from the aerosol-forming rods is drawn through the aerosol-cooling element before being transported to the mouth end of the aerosol-generating article.

The aerosol-cooling element preferably has a porosity in a longitudinal direction of greater than 50 percent. The airflow path through the aerosol-cooling element is preferably relatively uninhibited. The aerosol-cooling element may be a gathered sheet or a crimped and gathered sheet. The aerosol-cooling element may comprise a sheet material selected from the group consisting of polyethylene (PE), polypropylene (PP), polyvinylchloride (PVC), polyethylene terephthalate (PET), polylactic acid (PLA), cellulose acetate (CA), and aluminum foil or combinations thereof.

In a preferred embodiment, the aerosol-cooling element comprises a gathered sheet of biodegradable material. For example, a gathered sheet of non-porous paper or a gathered sheet of biodegradable polymeric material, such as for example polylactic acid or a grade of Mater-Bi® (a commercially available family of starch based copolyesters).

The aerosol-cooling element preferably comprises a sheet of PLA, more preferably a crimped, gathered sheet of PLA. The aerosol-cooling element may be formed from a sheet having a thickness of between 10 micrometer and 250 micrometer, in particular between 40 micrometer and 80 micrometer, for example 50 micrometer. The aerosol-cooling element may be formed from a gathered sheet having a width of between 150 millimeter and 250 millimeter. The aerosol-cooling element may have a specific surface area of between 300 square millimeter per millimeter length and 1000 square millimeter per millimeter length between 10 square millimeter per mg weight and 100 square millimeter per milligram weight. In some embodiments, the aerosol-cooling element may be formed from a gathered sheet of material having a specific surface area of about 35 square millimeter per milligram weight. The aerosol-cooling element may have an external diameter of between 5 millimeter and 10 millimeter, for example 7 millimeter.

In some preferred embodiments, the length of the aerosol-cooling element is between 10 millimeter and 15 millimeter. Preferably, the length of the aerosol-cooling element is between 10 millimeter and 14 millimeter, for example 13 millimeter. In alternative embodiments, the length of the aerosol-cooling element is between 15 millimeter and 25 millimeter. Preferably, the length of the aerosol-cooling element is between 16 millimeter and 20 millimeter, for example 18 millimeter.

The article may further comprise a wrapper surrounding at least a portion of the different elements mentioned above such as to keep them together and to maintain the desired cross-sectional shape of the article. Preferably, the wrapper forms at least a portion of the outer surface of the article. For example, the wrapper may be a paper wrapper, in particular a paper wrapper made of cigarette paper. Alternatively, the wrapper may be a foil, for example made of plastics. The wrapper may be fluid permeable such as to allow vaporized aerosol-forming substrate to be released from the article. A fluid permeable wrapper may also allow air to be drawn into the article through its circumference. Furthermore, the wrapper may comprise at least one volatile substance to be activated and released from the wrapper upon heating. For example, the wrapper may be impregnated with a volatile flavoring substance.

The present invention further relates to an aerosol-generating system comprising an inductively heatable aerosol-generating article according to the invention and as described herein. The system further comprises an inductively heating aerosol-generating device for use with the article. The aerosol-generating device comprises a receiving cavity for receiving the article at least partially in the receiving cavity. The aerosol-generating device further comprise an induction source including at least one induction coil for generating an alternating, in particular high-frequency electromagnetic field within the receiving cavity such as to inductively heat the susceptor of the article when the article is received in the receiving cavity. The at least one induction coil may be a helical induction coil which is arranged coaxially around the cylindrical receiving cavity.

The device may further comprise a power supply and a controller for powering and controlling the heating process. As referred to herein, the alternating, in particular high-frequency electromagnetic field may be in the range between 500 kHz to 30 MHz, in particular between 5 MHz to 15 MHz, preferably between 5 MHz and 10 MHz.

The aerosol-generating device may be, for example a device as described in WO 2015/177256 A1.

In use, the aerosol-generating article engages with the aerosol-generating device such that the susceptor is located within the fluctuating electromagnetic field generated by the inductor.

Further features and advantages of the aerosol-generating system according to the present invention have been described with regard to aerosol-generating article and equally apply.

The present invention further relates to a method for manufacturing an inductively heatable aerosol-generating article according to the present invention and as described herein. The method comprises the steps of:

providing an aerosol-forming substrate;

providing a susceptor which comprises an expanded metal sheet comprising a plurality of openings, wherein providing the susceptor comprises the steps of:

providing a metal sheet;

creating a plurality of weakened areas in the metal sheet; and stretching the weakened metal sheet at least along a first direction such as to create an expanded metal sheet comprising a plurality of openings originating from the plurality of weakened areas;

arranging the susceptor in thermal proximity with or thermal contact to the aerosol-forming substrate.

As used herein, the term "weakened area" refers to an area of the metal sheet which has a reduced material thickness in a direction perpendicular to the main surface of the metal sheet, that is, along a thickness extension of the metal. The reduction of the material thickness is such that upon stretching the weakened metal sheet the weakened area is transformed into an opening through the entire expanded sheet material along its thickness extension.

In particular, the weakened areas are local weakened areas. Accordingly, upon creating the plurality of weakened areas in the metal sheet, the metal sheet is a weakened, in particular a locally weakened metal sheet.

At the weakened area, the material thickness may be reduced by at least 50 percent, in particular by at least 60 percent, in particular by at least 70 percent, in particular by at least 80 percent, in particular by at least 90 percent, in particular by at least 95 percent of the material thickness of the metal sheet at non-weakened areas. Accordingly, the weakened area may be a recess or a cut or a slit, wherein the recess, the cut or the slit, respectively, has a depth in a direction perpendicular to the main surface of the metal sheet, that is, along a thickness extension of the metal, of at least 50 percent, in particular at least 60 percent, in particular at least 70 percent, in particular at least 80 percent, in particular at least 90 percent, in particular at least 95 percent of the material thickness of the metal sheet at non-weakened areas.

The weakened area may also be a perforation that extends through the entire sheet material along its thickness extension, from one plane side to the opposite plane side of the sheet material. Accordingly, the step of providing the susceptor comprises the steps of:

providing a metal sheet;

creating a plurality of perforations in the metal sheet; and stretching the perforated metal sheet at least along a first direction such as to create an expanded metal sheet comprising a plurality of openings originating from the plurality of perforations.

As already described above with regard to the article, the step of creating the plurality weakened areas, in particular a plurality of perforations, advantageously comprises the step of creating a plurality of slits of finite length into the metal sheet, wherein at least a portion of each slit extends along a second direction transverse, preferably perpendicular to the first direction, that is, transverse, preferably perpendicular to the direction of expansion. The slits may have a depth in a direction perpendicular to the main surface of the metal sheet, that is, along a thickness extension of the metal, of at least 50 percent, in particular at least 60 percent, in particular at least 70 percent, in particular at least 80 percent, in particular at least 90 percent, in particular at least 95 percent of the material thickness of the metal sheet at non-weakened areas. Preferably, the slits extend through the entire sheet material along its thickness extension, from one plane side to the opposite plane side of the sheet material.

One or more of the plurality weakened areas, in particular one or more of the plurality of perforations—preferably all weakened areas, in particular all perforations—are straight slits. Straight slits are very easy to manufacture. As described above with regard to the article, straight slits, in particular when extending in a direction perpendicular to the first direction, that is, the direction of expansion, result in rhombus-shaped openings upon stretching the weakened, in particular perforated metal sheet the first direction.

Other shapes of the openings may be achieved by choosing other shapes of the weakened areas, in particular perforations. For example, one or more of the plurality of weakened areas, in particular one or more of the plurality of perforations—preferably all weakened areas, in particular all perforations—may be curved slits, such as C-shaped slits or U-shaped slits or sickle-shaped slits. Likewise, one or more of the plurality of weakened areas, in particular one or more of the plurality of perforations—preferably all weakened areas, in particular all perforations—may be cross-shaped slits or T-shaped slits. With regard to cross-shaped slits, one of the slits—which corresponds to one bar of the cross shape—may extend perpendicular to the first direction, whereas the respective other slit—which corresponds to the other bar of the cross shape—may extend parallel to the first direction. Alternatively, both slits—each of which corresponds to one of the bars of the cross shape—may extend transverse to the first direction as well as transverse to a direction perpendicular to the first direction.

The plurality of weakened areas, in particular the plurality of perforations may be arranged in a periodic pattern such as to result in a plurality of openings arranged in a periodic pattern upon stretching the weakened, in particular perforated metal sheet.

The step of creating of a plurality of slits may include cutting a plurality of slits.

The step of creating of a plurality of slits may be realized by a slitter, in particular by a slitter that is part of an apparatus—described below—for manufacturing a susceptor of an aerosol-generating article according to the present invention. Like the apparatus described below, the slitter preferably is configured for a continuous through-feed process.

The slitter may comprise a first pair of counter-rotating first rolls, wherein at least one of the first rolls comprises one or more cutting elements arranged on the outer circumferential surface of the respective roll, wherein the one or more cutting elements are configured to create a plurality of weakened areas, in particular a plurality of perforations, such as for example a plurality of slits in the metal sheet when the metal sheet passes between the first rolls of the first pair.

The step of stretching the weakened, in particular perforated metal sheet may be realized by an expansion unit, in particular by an expansion unit that is part of an apparatus—described below—for manufacturing a susceptor of an aerosol-generating article according to the present invention, in particular in a continuous through-feed process. Accordingly, the expansion unit preferably is configured for a continuous through-feed process. Advantageously, the expansion unit is arranged downstream of the slitter described.

The expansion unit may comprise a second pair of counter-rotating second rolls, preferably arranged downstream of the first pair of first rolls, configured to convey the weakened, in particular perforated metal sheet therebetween at a first conveying velocity corresponding to a rotational speed of the second rolls. The expansion unit may further comprise a third pair of counter-rotating third rolls, arranged downstream of the second pair, configured to convey the weakened, in particular perforated metal sheet therebetween at a second conveying velocity corresponding to a rotational speed of the third rolls, wherein the rotational speed of the third rolls is higher than the rotational speed of the second rolls such that the weakened, in particular perforated metal sheet—when being conveyed by the second and third pair of rolls—is stretched along the direction of conveyance thereby turning in an expanded metal sheet which comprises a plurality of openings through the sheet originating from the plurality of weakened areas, in particular form the plurality of perforations.

The step of providing the susceptor may further comprise the step of flattening the expanded metal sheet after stretching.

This step may be realized by a flattening unit, in particular by a flattening unit that is part of an apparatus—described below—for manufacturing a susceptor of an aerosol-generating article according to the present invention, in particular in a continuous through-feed process. Accordingly, the flattening unit preferably is configured for a continuous through-feed process. Advantageously, the flattening unit is arranged downstream of the expansion unit described above.

The flattening unit may comprise a fourth pair of counter-rotating fourth rolls, arranged downstream of the third pair of third rolls, configured to convey the expanded metal sheet therebetween at a third conveying velocity corresponding to a rotational speed of the fourth rolls, wherein the rotational speed of the fourth rolls is higher than the rotational speed of the third rolls such that the expanded metal sheet—when being conveyed by the third and fourth pair of rolls—is straightened and flattened.

The step of arranging the susceptor in thermal proximity with or thermal contact to the aerosol-forming substrate may comprise arranging the aerosol-forming substrate at least partially around the susceptor.

Alternatively, the step of arranging the susceptor in thermal proximity with or thermal contact to the aerosol-forming substrate comprises arranging the aerosol-forming substrate at least partially around the susceptor or arranging the susceptor at least partially around the aerosol-forming substrate.

Advantageously, the method according to the present invention, or at least a part of the method according to the present invention, may be realized as a continuous process, for example, as described in general in WO 2016/184928 A1 or WO 2016/184929 A1. In such a continuous process, the aerosol-forming substrate may be provided as a substrate web, whereas the susceptor may be provided as a continuous susceptor profile as described before. The latter may comprise a continuous expanded metal sheet which comprises a plurality of openings. In particular, the continuous susceptor profile may result from a continuous through-feed process as described before, for example, by using an apparatus described below.

As an example for a continuous process, the method according to the present invention may comprise the steps step of:

- providing a substrate web comprising an aerosol-forming substrate;
- providing a continuous susceptor profile comprising a continuous expanded metal sheet which comprises a plurality of openings, wherein providing the continuous susceptor profile comprises the steps of:
  - providing a continuous metal sheet;
  - creating a plurality of weakened areas, in particular a plurality of perforations in the continuous metal sheet; and
  - stretching the weakened, in particular perforated continuous metal sheet at least along a first direction such as to create a continuous expanded metal sheet comprising a plurality of openings originating from the plurality of weakened areas, in particular from the plurality of perforations;
- gathering the substrate web around the susceptor profile such as to form a continuous rod-shaped strand having a cylindrical shape with a constant cross-section;
- cutting the continuous rod-shaped strand into individual aerosol-forming rods.

The aerosol-forming rods resulting from this method may be directly used as aerosol-generating article. Alternatively, the aerosol-forming rods may be used to form an aerosol-generating article—in particular a rod-shaped article as described above—which in addition to the aerosol-forming rod may comprise one or more of a support element having a central air passage, an aerosol-cooling element, and a filter element.

Usage of an expanded metal sheet as susceptor is advantageous with regard to the step of cutting the continuous rod-shaped strand into individual aerosol-forming rods since less material is to be cut as compared to a solid metal susceptor. Due to this, cutting is less challenging as it requires less mechanical force. As a result, the positional accuracy and stability of the susceptor within the final rod is further improved. Furthermore, the reduced amount of material to be cut advantageously increases the lifetime of the cutting means used for this process step. Moreover, having a reduced amount of material to be cut reduces the risk of particle migration into the aerosol-forming substrate. Such particle migration may be caused by particle ablation from the susceptor or the cutting means during the cutting process.

The method according to the specific example described before may further comprise the step of crimping the substrate web prior to positioning the susceptor profile and the substrate web relative to each other. In particular, the substrate web may be crimped longitudinally. That is, the substrate web may be provided with a longitudinal folding structure along a longitudinal axis of the continuous sheet, that is, along a transport direction of the substrate web. Preferably, the longitudinal folding structure provides the substrate with a zigzag or wave-like cross section. Advantageously, crimping the substrate web facilitates the step of gathering the substrate web in a transverse direction with respect to its longitudinal axis into the final rod shape. In particular, the longitudinal folding structure supports proper folding of the aerosol-forming substrate around the susceptor. This may be advantageous for manufacturing aerosol-forming rods with reproducible specifications. Even more, crimping the substrate web facilitates accurate positioning of a susceptor profile having periodically spaced narrower portions in the substrate web. As a result, the positional accuracy and stability of the susceptor profile within the aerosol-forming substrate is significantly improved.

The steps of providing the continuous susceptor profile and the substrate web, positioning the susceptor profile and the substrate web relative to each other, gathering the substrate web around the susceptor profile and cutting the continuous rod-shaped strand into individual aerosol-forming rods may be realized in principle in different ways, in particular by using one of the methods or apparatus described in WO 2016/184928 A1 or WO 2016/184929 A1.

In alternative to a continuous process, the method may be realized at least partially as a discontinuous process. In this case, the expanded metal may have a finite size. In particular, the metal sheet used to manufacture the expanded metal sheet may have a finite size. Accordingly, the method may comprise the steps of:

providing an aerosol-forming substrate;

providing a susceptor which comprises an expanded metal sheet of finite size comprising a plurality of openings, wherein providing the susceptor comprises the steps of:

providing a metal sheet of finite size;

creating a plurality of weakened areas, in particular a plurality of perforations in the metal sheet; and stretching the weakened, in particular perforated metal sheet at least along a first direction such as to create an expanded metal sheet of finite size comprising a plurality of openings originating from the plurality of weakened areas, in particular from the plurality of perforations;

arranging the susceptor in thermal proximity with or thermal contact to the aerosol-forming substrate.

Alternatively, the metal sheet used to manufacture the expanded metal sheet of finite may be a continuous metal sheet, which after the step of stretching may be cut into a plurality of expanded metal sheets of finite size. Accordingly, the method may comprise the steps of:

providing an aerosol-forming substrate;

providing a susceptor which comprises an expanded metal sheet of finite size comprising a plurality of openings, wherein providing the susceptor comprises the steps of:

providing a continuous metal sheet;

creating a plurality of weakened areas, in particular a plurality of perforations in the continuous metal sheet; and stretching the weakened, in particular perforated continuous metal sheet at least along a first direction such as to create a continuous expanded metal sheet comprising a plurality of openings originating from the plurality of weakened areas, in particular from the plurality of perforations;

cutting the continuous expanded metal sheet into a plurality of expanded metal sheets of finite size, one of which is used for providing the susceptor;

arranging the susceptor in thermal proximity with or thermal contact to the aerosol-forming substrate.

Further features and advantages of the method for manufacturing inductively heatable aerosol-generating article have been described above with regard to the aerosol-generating article according to the present invention and equally apply.

The present invention further relates to an apparatus for manufacturing a susceptor of an aerosol-generating article according to the present invention, in particular in a continuous process. The apparatus comprises:

a first pair of counter-rotating first rolls, wherein at least one of the first rolls comprises one or more cutting elements arranged on the outer circumferential surface of the respective roll, wherein the one or more cutting elements are configured to create a plurality of weakened areas, in particular a plurality of perforations, for example a plurality of slits in the metal sheet when the metal sheet passes between the first rolls of the first pair;

a second pair of counter-rotating second rolls, arranged downstream of the first pair of first rolls, configured to convey the weakened, in particular perforated metal sheet therebetween at a first conveying velocity corresponding to a rotational speed of the second rolls; and a third pair of counter-rotating third rolls, arranged downstream of the second pair of second rolls, configured to convey the weakened, in particular perforated metal sheet therebetween at a second conveying velocity corresponding to a rotational speed of the third rolls, wherein the rotational speed of the third rolls is higher than the rotational speed of the second rolls such that the weakened, in particular perforated metal sheet—when being conveyed by the second and third pair of rolls—is stretched along the direction of conveyance thereby turning in an expanded metal sheet which comprises a plurality of openings through the sheet originating from the plurality of weakened areas, in particular from the plurality of perforations.

Preferably, a rotational speed of the first rolls is equal to the rotational speed of the second rolls such that no expansion occurs between the first pair of first rolls and the second pair of second rolls.

In addition, the apparatus may comprise a fourth pair of counter-rotating fourth rolls, arranged downstream of the third pair of third rolls, configured to convey the expanded metal sheet therebetween at a third conveying velocity corresponding to a rotational speed of the fourth rolls, wherein the rotational speed of the fourth rolls is higher than the rotational speed of the third rolls such that the expanded metal sheet—when being conveyed by the third and fourth pair of rolls—is straightened and flattened.

As described above with regard to the method according to the present invention, the first pair of first rolls may be part of or may form a slitter. Likewise, the second and third pair of rolls may be part of or may form an expansion unit, whereas the fourth pair of rolls, possibly in combination with the third pair of rolls, may be part of or may form a flattening unit.

The apparatus may further comprise an adjustment mechanism for at least of one, preferably for each of the first, second, third and fourth pair of rolls. The respective adjustment mechanism may be configured to adjust at least one of the distance between the rolls of a respective pair or rolls, and an orientation, in particular an inclination of a rotational axis of each roll a respective pair of rolls. The respective adjustment mechanism may be part of the respective units described before.

Preferably, the apparatus may be used to perform at least parts of the method according to the present invention and as described herein, in particular in case the method is realized as a continuous process or as an at least partially discontinuous process.

Further features and advantages of the apparatus have been described above with regard to the aerosol-generating article and the method according to the present invention and equally apply.

The invention will be further described, by way of example only, with reference to the accompanying drawings, in which.

Figure 1:
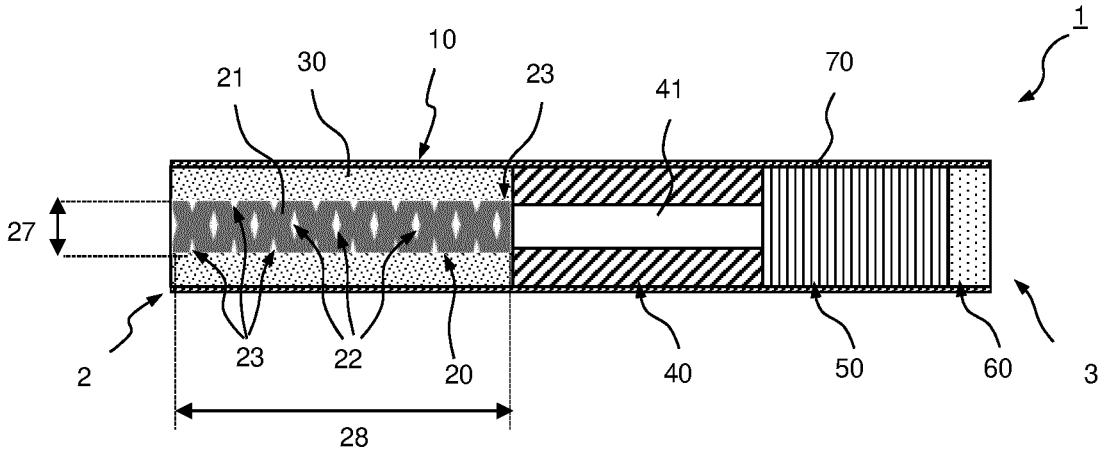
FIG. 1 is a schematic illustration of an inductively heatable aerosol-generating article according to an exemplary embodiment of the present invention.

FIG. 1 schematically illustrates an exemplary embodiment of an inductively heatable aerosol-generating article 1 according to the present invention. The aerosol-generating article 1 substantially has a rod-shape and comprises four elements sequentially arranged in coaxial alignment: an aerosol-forming rod 10 comprising a susceptor 20 and an aerosol-forming substrate 30, a support element 40, an aerosol-cooling element 50, and a filter element 60. The aerosol-forming rod 10 is arranged at a distal end 2 of the article 1, whereas the filter element 60 is arranged at a proximal end 3 of the article 1. The support element 40 may comprise a cartoon- or cellulose-based tube having a central air passage 41 which allows for mixing and homogenization of any aerosols generated inside the aerosol-forming rod 10. Alternatively, the support element 40 may be used for keeping separate different aerosols generated at different places inside the aerosol-forming rod separate until reaching the aerosol-cooling element 50. The aerosol-cooling element 50 mainly serves to reduce the aerosol temperature towards the proximal end 3 of the article 1. The aerosol-forming element may, for example, comprise biodegradable polymeric materials, cellulose-based materials with low porosity or combinations of these and other materials. The filter element 60 serves as a mouthpiece, possibly together with at least a portion of the aerosol-cooling element 50, through which the aerosol exits the aerosol-generating article 1. The filter element 60 may comprise standard filter materials, for example low density acetate tow. Each of the four elements 10, 40, 50, 60 is substantially cylindrical, all of them having substantially the same diameter or circumference. In addition, the four elements are circumscribed by an outer wrapper 70 such as to keep the four elements together and to maintain the desired circular cross-sectional shape of the rod-like article 1. The wrapper 70 preferably is made of paper.

The rod-shaped aerosol-generating article 1 may have a length between 30 millimeter and 110 millimeter, preferably between 40 millimeter and 60 millimeter. Likewise, the article 1 may have a diameter between 3 millimeter and 10 millimeter, preferably between 5.5 millimeter and 8 millimeter. Further details of the article, in particular of the four elements—apart from the specifics of the susceptor 20 within the rod 10—are disclosed in WO 2015/176898 A1.

Figure 2:
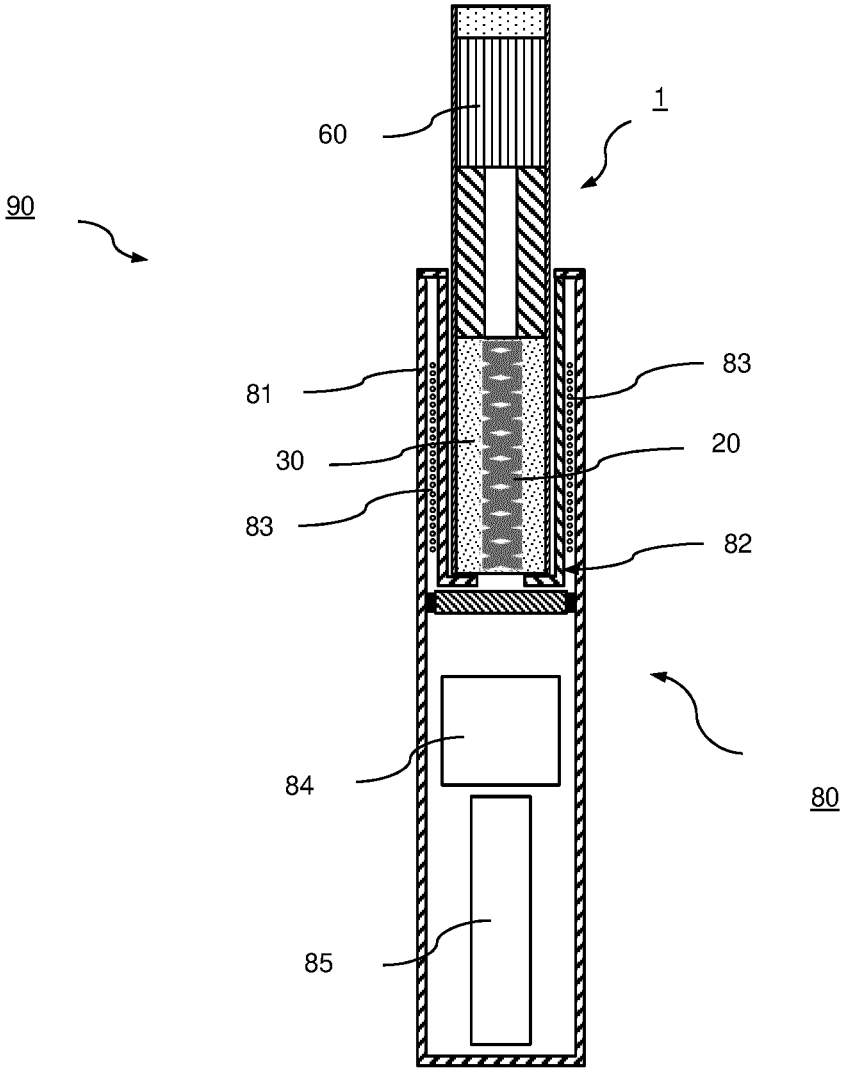
FIG. 2 is a schematic illustration an exemplary embodiment of an aerosol-generating system comprising an aerosol-generating device and the aerosol-generating article according to FIG. 1.

As illustrated in FIG. 2, the aerosol-generating article 1 is configured for use with an inductively heating aerosol-generating device 80. Together, the device 80 and the article 1 form an aerosol-generating system 90. The aerosol-generating device 80 comprises a cylindrical receiving cavity 82 defined within a distal portion of the device housing 81 for receiving a least a distal portion of the article 1 therein. The device 80 further comprises an induction source including an induction coil 83 for generating an alternating, in particular high-frequency electromagnetic field. In the present embodiment, the induction coil 83 is a helical coil circumferentially surrounding the cylindrical receiving cavity 82 such that the susceptor 20 of the article 1 may experience the electromagnetic field of the coil when the article 1 is received in the cavity 82. Thus, upon activating the induction source, the susceptor element 20 heats up until reaching a temperature sufficient to release material from the aerosol-forming substrate 30 surrounding the susceptor 20.

As can be further seen in FIG. 2, the device 80 further comprises a power supply 85 and a controller 84 (only schematically illustrated in FIG. 2) for powering and controlling the heating process. Preferably, the induction source is at least partially integral part of the controller 84.

According to the invention, the susceptor 20 is in thermal contact with the aerosol-forming substrate 30. In the embodiment of the article 1 as shown in FIG. 1 and FIG. 2, the aerosol-forming substrate 30 surrounds the susceptor 20 such as to define the overall cylindrical shape of the rod 10. The elongate susceptor 20 is substantially strip-shaped and arranged along a central axis of the article 1.

As seen in a plane perpendicular to the central axis of the article 1, the strip-shaped susceptor 20 has a rectangular cross-sectional profile, wherein a thickness extension of the susceptor 20 is smaller than a width extension 27 which in turn is smaller than a length extension 28 along the central axis. As can be seen in FIG. 1 and FIG. 2 The length 28 is approximately the same as the length of the aerosol-forming substrate 30, that is, the length of the rod 10.

According to the invention, the susceptor comprises an expanded metal sheet 21 which comprises a plurality of openings 22, 23 extending through the sheet 21 along its thickness extension. As will be described in more detail below, the openings 22, 23 in the expanded metal sheet 21 result from locally weakening, in particular perforating, and subsequently stretching a metal sheet such to form a regular pattern of openings originating from the expansion of the locally weakened areas of the metal sheet, in particular from the perforations in the metal sheet.

As described above, using an expanded metal sheet as susceptor 20 advantageously allows to save materials and production costs, and thus to conserve resources. In addition, due to the plurality of openings 22, 23, the susceptor 20 is permeable causing the airflow drawn through the article 1 to be enhanced as compared to an article comprising a non-permeable susceptor. In addition, the openings 22, 23 facilitate the release and entrainment of material that is volatilized from the heated aerosol-forming substrate 30 into the airflow through the article 1.

In the present embodiment, the expanded metal sheet 21 of the susceptor 20 comprises two types of openings, namely, openings 22 having a closed boundary, that is, which are completely bounded by the material of the expanded metal sheet 21, and openings 23 having a partially open boundary, that is, which are only partially bounded by the material of the expanded metal sheet 21. The latter are located at both side edges of the strip-shaped susceptor 20. That is, the openings 23 are laterally opened up towards a respective side edge.

As shown in FIG. 1 and FIG. 2, the openings 22 have a substantially rhombus shape, whereas the openings 23 have a substantially triangular shape. In the present embodiment, both types of openings 22, 23 result from the expansion of perforations which have been created in into a metal sheet prior to expansion. The perforations are substantially straight slits of finite length that have been cut into the metal sheet prior to expansion. The slits which result in the partially unbound openings 23 upon expansion have been cut such as to extend beyond the side edge of the metal sheet. In contrast, the slits which result in the bounded openings 22 have been cut such as to be completely within the boundaries of the metal sheet. In the present embodiment, the both types of slits are oriented perpendicular to the direction along the metal sheet has been expanded, which is the length extension of the expanded metal sheet 21.

As can be further seen in FIGS. 1 and 2, the expanded metal sheet 21 comprises a single row of rhombus-shaped openings 22 along a center line of the strip-shaped susceptor 20, that is, parallel to its length extension. Between each neighboring rhombus-shaped openings 22, two partially bounded openings 23 are arranged in an offset configuration at opposite side edges of the strip-shaped susceptor 20. Due to this periodic offset pattern of the openings 22, 23, the susceptor 20 advantageously has an increased density of openings per unit area which results in high permeability and a low total mass per unit area. The rhombus-shaped openings 22 have a first diagonal connecting a first pair of opposite vertices of the rhombus shape and a second diagonal connecting a second pair of opposite vertices of the rhombus shape. As described above, the first diagonal extends in a first direction which corresponds to the direction of expansion of the expanded metal sheet, which in turn is perpendicular to the length extension of the straight slits from which the rhombus-shaped openings 22 result upon expansion. The length of the first diagonal may be in a range of 0.3 millimeter to 3.1 millimeter, preferably in a range of 0.5 millimeter 2.5 millimeter. Likewise, the length of the second diagonal is in a range of 1.7 millimeter to 4.7 millimeter, preferably in a range of 1.1 millimeter to 3.1 millimeter. The shortest distance between the rhombus-shaped openings and the closest side edge of the strip-shaped metal sheet 21 of the susceptor 20 may be in a range of 1.7 millimeter to 4.3 millimeter, preferably in a range of 1.5 millimeter 2.0 millimeter. The length of the open edge of the triangular openings 23 along the side edge of the susceptor 20 may be in a range of 0.2 millimeter to 2.7 millimeter, preferably in a range of 0.3 millimeter 1.1 millimeter.

Figure 3:
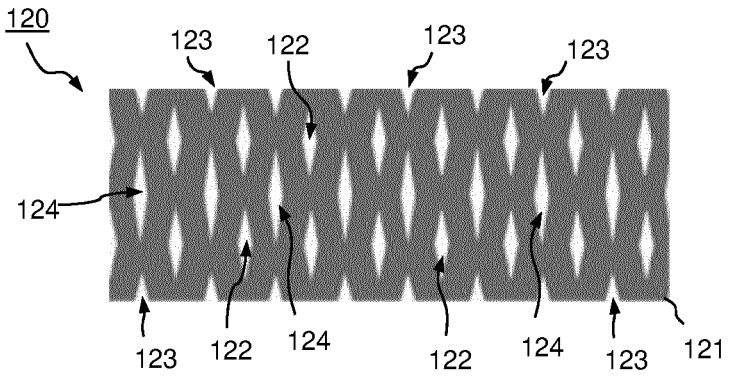
FIG. 3 illustrates a further exemplary embodiment of a susceptor which may be used to form an aerosol-generating article according to FIG. 1.

Depending on the width of the strip-shaped susceptor and the size of the openings, the susceptor may comprise more than one row of completely bounded openings. Such a configuration is illustrated in FIG. 3 which shows an alternative embodiment of a strip-shaped susceptor 120. The strip-shaped susceptor 120 according to this embodiment comprises two rows of rhombus-shaped openings 122 symmetrically arranged along a center line of the susceptor 120 parallel to its length extension. Between each neighboring rhombus-shaped openings 122, the susceptor 120 comprises one central rhombus-shaped opening 124 and two partially bounded openings 123 at the opposite side edges of the susceptor 120. The central rhombus-shaped opening 124 and the two partially bounded openings 123 are arranged in an offset configuration relative to the rhombus-shaped openings 122 in the respective neighboring rows.

With regard to both embodiments of the susceptor 20, 120, the respective expanded metal sheet 21, 121 preferably is a bi-layer sheet comprising a first layer made of ferromagnetic stainless steel which comprises at least on one side a nickel coating which forms a second of the bi-layer sheet. Due to the magnetic and electrical properties of ferromagnetic stainless steel, the first layer is inductively heated due to both, eddy currents and hysteresis loss. Hence, the first layer is optimized with regard to heat loss and thus provides the main heating. In contrast, the second layer primarily is used as temperature marker. This is based on the magnetic properties of nickel having a Curie temperature which is approximately the same as the temperature that the susceptor 20 should be heated to in order to generate an aerosol from the substrate 30, but which is still low enough to avoid local overheating or burning of the substrate 30.

Figure 4:
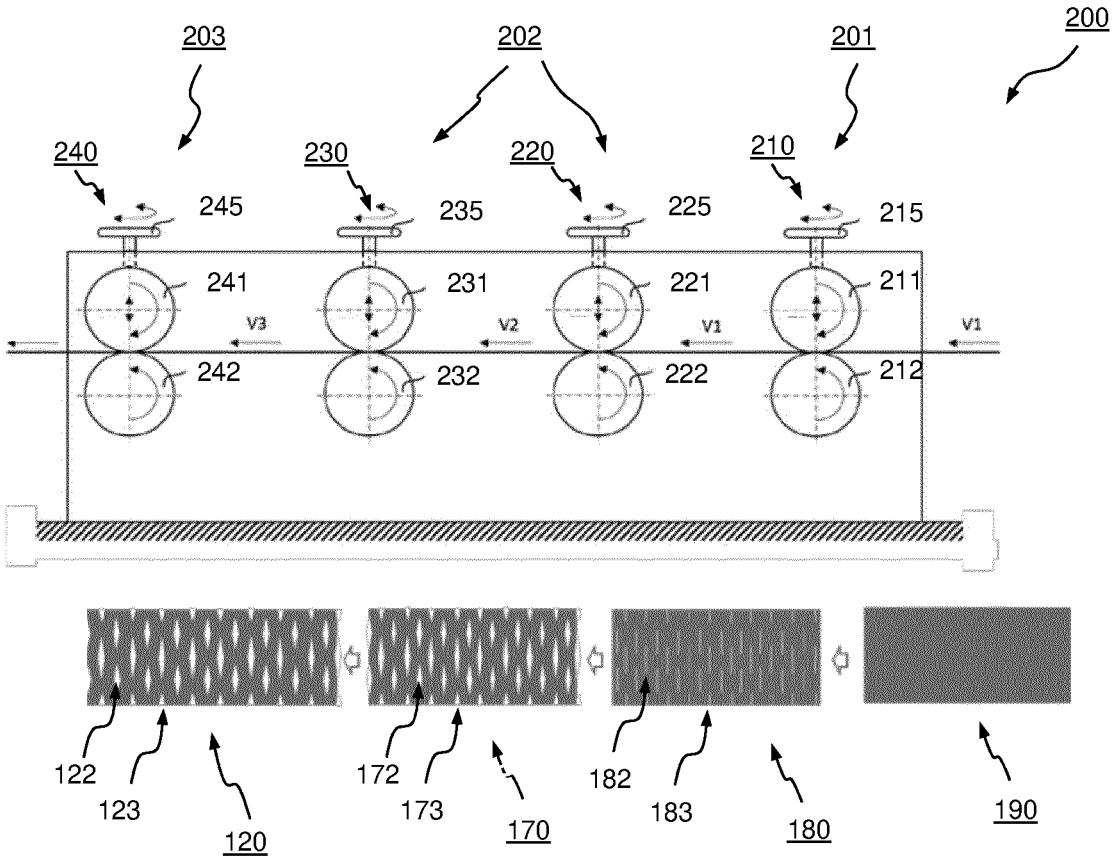
FIG. 4 schematically illustrate an exemplary embodiment of an apparatus for manufacturing a susceptor which may be used to form an aerosol-generating article according to the present invention.

FIG. 4 schematically illustrate an exemplary embodiment of an apparatus 200 for manufacturing a susceptor 120 which may be used to form an aerosol-generating article according to the present invention.

Preferably, the apparatus 200 may be used to perform at least parts of the method according to the present invention for manufacturing an inductively heatable aerosol-generating article, in particular to perform the step of providing a susceptor which comprises an expanded metal sheet comprising a plurality of openings.

The upper part of FIG. 4 illustrates the apparatus 200 itself, whereas the lower part of FIG. 4 illustrates the functioning and results of the different units of the apparatus 200 and of the different sub-steps of providing a susceptor 120.

According to the invention, the step of providing a susceptor 120 starts with providing a metal sheet 190. Preferably, the metal sheet 190 is provided as a continuous metal sheet, for example as a metal tape, provided on a bobbin. For this, the apparatus may comprise an unwinding unit to unwind the continuous metal sheet from the bobbin (not shown).

Next, the step of providing a susceptor 120 comprises the step of creating a plurality of weakened areas in the metal sheet. In the embodiments, the weakened areas are perforations in the metal sheet. For this, the apparatus 200 comprises a slitter 201. The slitter 201 comprises a first pair 210 of counter-rotating first roles 211, 212 which the metal sheet 190 is fed in between at an upstream end of the apparatus 200. At least one of the first rolls 211, 212 comprises one or more cutting elements arranged on the outer circumferential surface of the respective roll 211, 212 (not shown). The one or more cutting elements are configured to create a plurality of perforations in the metal sheet 190 when the metal sheet 190 passes between the first rolls 211, 212. Accordingly, this process results in a perforated metal sheet 180 at the downstream end of the slitter 201. In the present embodiment of the apparatus 200, the cutting elements of the slitter 201 are configured to create a periodic pattern of straight slits 182, 183 which extend perpendicular to the direction of travel of the metal sheet through the apparatus 200. As shown in the lower part of FIG. 4 (second sub-figure from the right), the resulting perforated metal sheet 180 comprises slits 182 which are completely within the boundaries of the metal sheet, as well as slits 183 which extend beyond the side edge of the metal sheet.

Next, the step of providing a susceptor 120 comprises the step of stretching the weakened, in particular perforated metal sheet 180 at least along a first direction such as to create an expanded metal sheet 190 comprising a plurality of openings originating from the plurality of perforations 182, 183. For this, the apparatus 200 comprises an expansion unit 202.

The expansion unit 202 includes a second pair 220 of counter-rotating second rolls 221, 222, arranged downstream of the first pair 210 of first rolls 211, 212. The second rolls 221, 222 are configured to convey the weakened, in particular perforated metal sheet 180 therebetween at a first conveying velocity V1 corresponding to a rotational speed of the second rolls 221, 222. Preferably, a rotational speed of the first rolls 211, 212 is equal to the rotational speed of the second rolls 221, 222 such that no stretching occurs between the first pair 210 of first rolls 211, 212 and the second pair 220 of second rolls 221, 222.

Downstream of the second pair 220 of second rolls 221, 222, the expansion unit 202 comprises a third pair 230 of counter-rotating third rolls 231, 232 which are configured to convey the weakened, in particular perforated metal sheet 180 therebetween at a second conveying velocity V2 corresponding to a rotational speed of the third rolls 231, 232. The rotational speed of the third rolls 231, 232 is higher than the rotational speed of the second rolls 221, 222 such that the weakened, in particular perforated metal sheet 180—when being conveyed by the second and third pair of rolls 220, 230—is stretched along the direction of conveyance. Thereby, the weakened, in particular perforated metal sheet 180 is turned in an expanded metal sheet 170 which comprises a plurality of openings 172, 173 originating from the plurality of perforations 182, 183.

Downstream of the third pair 230 of third rolls 231, 232, the apparatus 200 comprise a flattening unit 203. The flattening unit 203 comprises a fourth pair 240 of counter-rotating fourth rolls 241, 242 which are configured to convey the expanded metal sheet 170 therebetween at a third conveying velocity V3 corresponding to a rotational speed of the fourth rolls 241, 242. The rotational speed of the fourth rolls 241, 242 is chosen to be higher than the rotational speed of the third rolls 231, 232 such that the expanded metal sheet 170—when being conveyed by the third and fourth pair of rolls 230, 240—is straightened and flattened.

At the downstream end of the apparatus 200, the above described steps finally result in a (continuous) flattened expanded metal sheet 200 which may be used to form a susceptor 120 as shown in FIG. 3.

As further illustrated in FIG. 4, the apparatus 200 may further comprise an adjustment mechanism 215, 225, 235, 245 for each of the first, second, third and fourth pair of rolls 210, 220, 230, 240. The respective adjustment mechanism 215, 225, 235, 245 is configured to adjust the distance between the rolls of a respective pair 210, 220, 230, 240 as well as an orientation, in particular an inclination of a rotational axis of each roll a respective pair of rolls 210, 220, 230, 240.

As described above, the apparatus 200 preferably is used to perform the step of providing a susceptor according to the method of the present invention, in particular in case the method is realized as a continuous process. According to this aspect, the method may further comprise—in parallel, prior or after providing the susceptor—the step of providing a substrate web comprising an aerosol-forming substrate. Subsequently, the method may comprise step of gathering the substrate web around the susceptor profile such as to form a continuous rod-shaped strand having a cylindrical shape with a constant cross-section and next the step of cutting the continuous rod-shaped strand into individual aerosol-forming rods. The aerosol-forming rods resulting from this method may be directly used as aerosol-generating article. Alternatively, the aerosol-forming rods 10 may be used to form an aerosol-generating article 1 as shown in FIG. 1.

The invention claimed is:

1. An inductively heatable aerosol-generating article for an inductively heating aerosol-generating device, the article comprising:

at least one aerosol-forming substrate; and at least one susceptor in thermal proximity with the at least one aerosol-forming substrate or thermal contact with the at least one aerosol-forming substrate, the at least one susceptor comprising a flattened expanded metal sheet comprising a plurality of openings through the flattened expanded metal sheet and having no raised portions which protrude in a direction perpendicular to the main plane surface of the flattened expanded metal sheet.

2. The inductively heatable aerosol-generating article according to claim 1, wherein the plurality of openings is arranged in a periodic pattern.

3. The inductively heatable aerosol-generating article according to claim 1, wherein one or more of the plurality of openings have a rhombus shape.

4. The inductively heatable aerosol-generating article according to claim 3, wherein the rhombus shape has a first diagonal connecting a first pair of opposite vertices of the rhombus shape and a second diagonal connecting a second pair of opposite vertices of the rhombus shape, and wherein the first diagonal extends in a direction of expansion of the expanded metal sheet.

5. The inductively heatable aerosol-generating article according to claim 4, wherein a length of the first diagonal is in a range of 1.7 millimeter to 4.7 millimeter, and a length of the second diagonal is in a range of 0.3 millimeter to 3.1 millimeter.

6. The inductively heatable aerosol-generating article according to claim 1, wherein one or more of the plurality of openings are laterally opened up towards a side edge of the flattened expanded metal sheet and have a triangular shape.

7. The inductively heatable aerosol-generating article according to claim 1, wherein the at least one aerosol-forming substrate is arranged at least partially around the at least one susceptor.

8. The inductively heatable aerosol-generating article according to claim 1, wherein the at least one aerosol-forming substrate comprises a non-tobacco plant material.

9. The inductively heatable aerosol-generating article according to claim 1, wherein the at least one aerosol-forming substrate comprises an aerosol-former with a weight proportion in a range of 12 percent to 20 percent by weight of the at least one aerosol-forming substrate.

* * * * *